US005759988A

United States Patent [19]

Heile et al.

[11] Patent Number: 5,759,988

[45] Date of Patent: Jun. 2, 1998

[54] STABLE HYGROSCOPIC DETERGENT ARTICLE

[75] Inventors: Bernard Joseph Heile, Apple Valley; James John Tarara, Woodbury, both of Minn.

[73] Assignee: Ecolab Inc., St. Paul, Minn.

[21] Appl. No.: 755,121

[22] Filed: Nov. 22, 1996

Related U.S. Application Data

[63] Continuation of Ser. No. 175,627, Dec. 30, 1993, abandoned.

[51] Int. Cl.[6] ..... C11D 17/00; C11D 11/00; C11D 7/06

[52] U.S. Cl. ..... 510/441; 510/108; 510/224; 510/225; 510/294; 510/298; 510/445; 510/446; 510/451; 510/467; 510/475; 510/501; 510/509; 510/511

[58] Field of Search ..... 510/224, 225, 510/294, 298, 441, 445, 446, 451, 467, 475, 501, 509, 511, 108

[56] References Cited

U.S. PATENT DOCUMENTS

| | | | |
|---|---|---|---|
| Re. 32,763 | 10/1988 | Fernholz et al. | 252/90 |
| Re. 32,818 | 1/1989 | Fernholz et al. | 252/90 |
| 3,318,817 | 5/1967 | Smith | 252/137 |
| 3,407,144 | 10/1968 | Bath | 252/108 |
| 3,894,466 | 7/1975 | Wibrow | 85/10 F |
| 4,219,435 | 8/1980 | Biard et al. | 252/90 |
| 4,219,436 | 8/1980 | Gromer et al. | 252/135 |
| 4,545,784 | 10/1985 | Sanderson | 8/107 |
| 4,664,836 | 5/1987 | Taylor, Jr. et al. | 510/441 |
| 4,774,014 | 9/1988 | Kuenzel et al. | 252/90 |
| 4,798,724 | 1/1989 | Khanna | 424/480 |
| 5,198,198 | 3/1993 | Gladfelter et al. | 422/264 |
| 5,234,615 | 8/1993 | Gladfelter et al. | 252/90 |
| 5,316,688 | 5/1994 | Gladfelter et al. | 252/90 |
| 5,627,150 | 5/1997 | Peterson et al. | 510/439 |

FOREIGN PATENT DOCUMENTS

| | | |
|---|---|---|
| 0 002 293 | 6/1979 | European Pat. Off. . |
| 0002293 | 6/1979 | European Pat. Off. . |
| 0 055 100 | 6/1982 | European Pat. Off. . |
| 989 683 | 4/1965 | United Kingdom . |
| 1031831 | 6/1966 | United Kingdom . |
| 92/01037 | 1/1992 | WIPO . |
| 93/01266 | 1/1993 | WIPO . |

*Primary Examiner*—Paul Lieberman
*Assistant Examiner*—Lorna M. Douyon
*Attorney, Agent, or Firm*—Merchant, Gould, Smith, Edell, Welter & Schmidt, P.A.

[57] ABSTRACT

There is provided an environmentally stable detergent article. Normally, hygroscopic caustic detergent materials can be made resistant to absorption of ambient humidity or water by introducing a barrier coating onto the caustic detergent. The barrier also renders the highly active alkaline material safe for human handling. The coated detergent article can further be enclosed in a film enclosure or wrapping which provides further protection for handling during production, shipment, storage and final end use. The coated article can be removed from any packaging material, inserted into a water spray-on dispenser and used to create a concentrated aqueous detergent for use in ware washing machines. In order to obtain control over dispensing, hydrophobic coatings can be nicked, split, peeled or partially removed using other means to provide an initial surface of caustic detergent exposed to the water spray. The water spray can then dispense the detergent and either melt or dissolve the hydrophobic coating in a controlled manner.

38 Claims, No Drawings

STABLE HYGROSCOPIC DETERGENT ARTICLE

This is a continuation of application Ser. No. 08/175,627, filed Dec. 30, 1993 now abandoned.

FIELD OF THE INVENTION

The invention is directed to stabilized hygroscopic solid block alkaline detergent material that can be used in a variety of cleaning regimens including institutional and industrial ware washing, laundry, hard surface cleaning, etc. The caustic detergent comprises typically a source of alkalinity, a hardness sequestering agent and other active ingredients useful in the washing regimen. The detergent articles of the invention are stabilized to the absorption of water from the environment and are suitable for handling by human operators of washing equipment. The invention also relates to methods of using the stabilized hygroscopic detergent in a cleaning regimen.

BACKGROUND OF THE INVENTION

The development of solid block cleaning compositions has revolutionized the manner in which detergent compositions are dispensed by commercial and institutional ware washing, laundry, hard surface cleaning equipment.

Such equipment routinely use large quantities of cleaning materials by inserting large block detergent articles into dispensers which convert the solid detergent into a concentrate using a water spray. The concentrate is directed to a use locus, typically a ware washing machine, laundry washing machine, etc. Solid block compositions offer the unique advantages over other forms of detergents including improved handling, enhance safety, elimination of component segregation during transportation, storage and use and increase concentrations of active ingredients within the composition.

Because of the benefits, the solid cleaning compositions such as those disclosed in Fernholz, U.S. Reissue Pat. Nos. 32,763 and 32,818 have quickly replaced conventional forms of ware washing detergents in commercial and institutional markets. In large part, commercial solid cast materials are packaged in disposable thermoplastic bottles or capsules. The highly alkaline materials are dispensed from the plastic capsule using a water spray within a dispenser apparatus. When the alkaline detergent is consumed during ware washing operations, the plastic capsule remains for disposal or recycling. Other alkaline materials are packaged in disposable or soluble wrapping material such as Gladfelter, U.S. Pat. Nos. 5,198,198 and 5,234,615 and as shown in Gladfelter U.S. Ser. No. 07/699,688. In this packaging alternative, a soluble detergent cake or soluble pellets are introduced into a water soluble wrapping or film enclosure. The article is then inserted directly into a spray on dispenser wherein the entire package and contents are dispensed into a use locus. No detergent or any soluble wrapping remains in the dispenser once consumed.

Colgate Palmolive United Kingdom Patent No. 1,031,831 teaches a non-caustic organic surfactant based detergent tablet having a colored coating of a water soluble polymer. The detergent tablet contains a water soluble organic detergent such as an alkyl benzene sulfonate, higher fatty alcohol sulfates, etc. coated with a water soluble coating made from film forming ingredients such as a film forming synthetic organic polymer that will dissolve readily in water such as polyvinyl alcohol, ethoxylated polyvinyl alcohol, sodium carboxy methyl cellulose, hydroxy propyl methyl cellulose, hydroxy ethyl cellulose and polyvinyl pyrrolidone. Based on the disclosure of the Colgate Palmolive patent, the patent is primarily directed to a single use household laundry tablet. Such a tablet contains less than about 200 grams total of typically household laundry detergent materials. Biard et al., U.S. Pat. No. 4,219,435, teach alkaline detergent tablets for ware washing and typical laundry detergent tablets that are enclosed in an inorganic hydrated salt coating. The coating comprises a hydrated salt having a melting point of 30°–90°C. including sodium acetate, sodium metaborate, sodium orthophosphate, sodium potassium tartrate, potassium aluminum sulfate and other such hydrates. Gromer et al., U.S. Pat. No. 4,219,436, teach a high density, high alkalinity, single unit dose dish washing detergent tablet. Gromer et al teach that the automatic dish washing detergent tablet, configured for use in a household machine, contains as a source of alkalinity, an alkaline silicate material. Gromer et al. teach that the detergent tablets must be made in such a manner that the density of the tablet be greater than 1.4 grams per cubic centimeter in order to provide effective cleaning. Gromer et al. teach that the tablets are preferably surfactant free. However, if surfactant is used, Gromer et al. teach that the surfactant be sprayed onto carrier particles or onto some portion of the active ingredients prior to tableting. Gromer et al. do not teach the use of organic materials as a stabilizing coating.

Alkaline detergent articles comprising some substantial proportion of an alkali metal hydroxide or other compositions with similar alkalinity are substantially hygroscopic. If left unprotected from atmospheric humidity, the materials when exposed to the ambient atmosphere absorb substantial quantities of water at a rate substantially greater than about 20 grams of water per 100 grams of alkaline detergent material per day (conditions: 100° F. and 65% rel. humidity). The absorption of such quantities of water rapidly renders the cast article unsuitable for use in most dispensing apparatus. The water softens the article to a degree that it cannot be easily handled and swells to a degree that it no longer can be easily inserted into dispensers. After an initial rapid absorption, the water absorption rate is reduced as the water saturates the surface and prevents continued rapid absorption. The alkaline detergent article contains sufficient alkalinity to be substantially corrosive to the user and to other surfaces common in the work place. The absorbance of significant amounts of water increase the corrosivity of the material and also increases the chances that users or services common in the use locus can be contaminated with a corrosive material. Additionally, the absorbed water can affect the physical stability and dimensional stability of the cast product. The cast products are sized with dimensions that ensure the cast block can be readily inserted into a spray on dispenser and can be used to regularly dispense or control the amount of detergent. Such a cast material requires physical stability, i.e. the material remains a solid block having substantial surface hardness and does not, in an important sense, change from a solid into a liquid paste or gel form. Further, the dimensions of the cast block should remain substantially constant and be sized appropriately for easy insertion into a dispenser. Accordingly, a substantial need exists for developing a moisture resistant multi-use detergent article. The resistant article prevents absorption of environmental humidity into the cast detergent material. The coated cast detergent article preferably absorbs less than about 2 grams water per 100 grams of material per day when exposed to the ambient atmosphere. Further, the article preferably provides enhanced safety during use. Contact between the user or sensitive surfaces is prevented in the use locus to the highly alkaline materials in the detergent article.

BRIEF DESCRIPTION OF THE INVENTION

The invention relates to an alkaline detergent article comprising a solid block detergent mass having a barrier coating. The barrier coating provides safety and stability to the detergent mass. The detergent mass is rendered safe for handling by personnel involved in inserting the detergent article into a water spray detergent dispenser. Further, the barrier provides a stability benefit in that the alkaline mass does not absorb substantial quantities of water, substantially reducing the utility of the detergent mass in washing operations. The detergent article coating stabilizes the detergent mass such that the detergent mass does not absorb more than 2, preferably less than 5 grams of water per 100 grams of detergent mass per day at the conditions discussed above. When viewed on a 30 day basis, the coated detergent article should not absorb more than 5 grams of water per 100 grams of detergent. At room temperature (70°–75° F.) and about 50% relative humidity, the coated detergent mass gains little or no water, preferably gains between 0.3 and 5 grams of water per 100 grams of detergent on a 30 day basis. Using more severe conditions of 100° F. and 65% relative humidity, the detergent mass preferably gains from 0.8 to 4 grams of water per 100 grams of detergent on a 30 day basis when coated with the coatings of the invention.

The detergent article comprising a coating on a detergent mass can optionally be packaged in a film envelope. The film can be a flexible sheet like material that is insoluble in aqueous materials, including alkaline and acidic aqueous solutions. Further, the film envelope can comprise polymeric materials that are insoluble in any aqueous material or soluble only in aqueous alkaline systems or only in aqueous acidic systems.

Another aspect of the invention relates to hydrophobic coatings on the detergent mass in a detergent article that require an initial step in introducing a passage for water or other dispensing stream through the coating prior to insertion of the detergent article in the dispenser. Some hydrophobic coatings are substantially water resistant and can resist the effects of the dispensing stream for a significant period of time before the coating is melted, dissolved or worn away by the water stream. To ensure the dispensing of adequate proportions of the detergent mass in the presence of a newly installed detergent article, the detergent coating can be breached, cut, or partially removed in such a way that access is provided for the water stream into the detergent mass as it is inserted into the dispenser.

The detergent article of the invention is typically manufactured by blending the detergent ingredients in a moldable, plastic or liquid form shaping the liquid into a detergent mass having a desired shape for ease of insertion into a dispenser, coating the mass with a preferred coating composition and optionally packaging the detergent article in a film envelope. In use the film envelope, if used, is opened, the detergent article removed from the envelope and inserted into a dispenser. The coating on the detergent article can be compromised to ensure that the initial contact between the article and the dispensing spray dissolve at least some portion of the detergent creating a concentrate for use in the use locus.

For the purposes of this application, the term "detergent mass" relates to a bulk solid mass of alkaline detergent typically greater than about 100 grams, typically 0.5 Kg to 5 Kg or 2 Kg to 5 Kg, to that can be inserted into a dispenser that uses a spray directed onto a surface of the detergent mass hence the detergent as an aqueous concentrate to a washing locus. The term "detergent article" connotes the detergent mass having a barrier coating.

DETAILED DESCRIPTION OF THE INVENTION

The invention provides a detergent article comprising a detergent mass having an integral coating substantially covering the detergent mass to the degree that the detergent mass absorbs environmental water at a rate such that the detergent can be handled and dispensed in spray on type dispensers. The detergent article can optionally be packaged in a flexible film envelope to provide additional protection to the detergent article.

The detergent article of the invention can be made having a detergent mass comprising a variety of solid cleaning compositions. The detergent mass can be used to form concentrates comprising detergent compositions, sanitizing compositions, conveyor lubricants, floor cleaners and the like. The cleaning compositions of the invention typically comprise conventional active ingredients that can be blended to obtain the properties required in the type of composition being manufactured. Typical ingredients used in the detergent mass of this invention includes a variety of ingredients as discussed below.

Alkaline Sources

The cleaning composition produced according to the invention may include effective amounts of one or more alkaline sources to enhance cleaning of a substrate and improve soil removal performance of the composition. The composition can comprise about 1–75 wt-% of a source of alkalinity, preferably about 10–50 wt-%.

Suitable alkali metal hydroxides include, for example, sodium or potassium hydroxide. An alkali metal hydroxide may be added to the composition in the form of solid beads dissolved in an aqueous solution, or a combination thereof. Alkali metal hydroxides are commercially available as a solid in the form of prilled beads having a mix of particle sizes ranging from about 12–100 U.s. mesh, or as an aqueous solution, as for example, as a 50 wt-% and a 73 wt-% solution. It is preferred that the alkali metal hydroxide is added in the form of an aqueous solution, preferably a 50 wt-% hydroxide solution, to reduce the amount of heat generated in the composition due to hydration of the solid alkali material.

A cleaning composition may comprise another alkaline source other than an alkali metal hydroxide. Examples of useful secondary alkaline sources include a metal silicate such as sodium or potassium silicate or metasilicate, a metal carbonate such as sodium or potassium carbonate, bicarbonate, sesquicarbonate, and the like; a metal borate such as sodium or potassium borate, and the like; ethanolamines and amines; and other like alkaline sources. Such alkalinity agents are commonly available in either aqueous or powdered form, either of which is useful in formulating the present cleaning compositions. The amount of water in the detergent mass can be important. Excess water can promote the decomposition of the coating or the film envelope. Water content of the detergent mass should be maintained between 1 to 30 wt.-% water of hydration, preferable 10 to 15 wt.-%.

Secondary Hardening Agents/Solubility Modifiers

The present compositions include an effective amount of a secondary hardening agent, as for example, an amide such stearic monoethanol amide or lauric diethanol amide, or an alkylamide, and the like; a solid polyethylene glycol or a propylene glycol, and the like; starches that have been made water soluble through an acid or alkaline treatment process; various inorganics that impart solidifying properties to a heated composition upon cooling, and the like. Such compounds may also vary the solubility of the composition in an aqueous medium during use such that the cleaning agent and/or other active ingredients may be dispensed from the solid composition over an extended period of time. The composition may include a secondary hardening agent in an amount of about 5–20 wt-%, preferably about 10–15 wt-%.

Detergent Fillers

A cleaning composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, $C_1$–$C_{10}$ alkylene glycols such as propylene glycol, and the like. Preferably, a detergent filler is included in an amount of about 1–20 wt-%, preferably about 3–15 wt-%.

Defoaming Agents

A minor but effective amount of a defoaming agent for reducing the stability of foam may also be included in the present urea-based cleaning compositions. Preferably, the cleaning composition includes about 0.0001–5 wt-% of a defoaming agent, preferably about 0.01–1 wt-%.

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-redeposition Agents

A cleaning composition may also include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. A cleaning composition may include about 0.5–10 wt-%, preferably about 1–5 wt-%, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz, Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Chelating/sequestering Agents

The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. Preferably, a cleaning composition includes about 0.1–70 wt-%, preferably 1 to 40 wt %, and more preferably from about 5–50 wt-%, of a chelating/sequestering agent.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as aminotris(methylene phosphonic acid), hydroxyethylidene diphosphonic acid, ethylenediaminetetrae(methylene phosphonic acid), diethylenetriaminepente(methylene phosphonic acid), and the like. It is preferred to use a neutralized or alkaline phosphonate, or to combine the phosphonate with an alkali source prior to being added into the mixture such that there is little or no heat generated by a neutralization reaction when the phosphate is added.

Polyacrylates suitable for use as cleaning agents include, for example, polyacrylic acid, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, *Encyclopedia of Chemical Technology*, Third Edition, volume 5, pages 339–366 and volume 23, pages 319–320, the disclosure of which is incorporated by reference herein.

Cleaning Agents

The composition comprises at least one cleaning agent which is preferably a surfactant or surfactant system. A variety of surfactants can be used in a cleaning composition, including anionic, cationic, nonionic and zwitterionic surfactants, which are commercially available from a number of sources. For a discussion of surfactants, see Kirk-Othmer, *Encyclopedia of Chemical Technology*, Third Edition, volume 8, pages 900–912. Preferably, the cleaning composition comprises a cleaning agent in an amount effective to provide a desired level of cleaning, preferably about 30–95 wt-%, more preferably about 50–85 wt-%.

Anionic surfactants useful in the present urea-based cleaning compositions, include, for example, carboxylates such as alkylcarboxylates and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are sodium alkylarylsulfonate, alpha-olefinsulfonate, and fatty alcohol sulfates.

Nonionic surfactants useful in cleaning compositions, include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols (Dehypon LT 104; Henkel); polyalkylene oxide free nonionics such as alkyl polyglycosides (Glucopon 225; Henkel); amine oxides; sorbitan and sucrose esters and their ethoxylates; alkoxylated ethylene diamine; alcohol alkoxylates such as alcohol ethoxylate propoxylates, alcohol propoxylate ethoxylate propoxylates, alcohol ethoxylate butoxylates, and the like; nonylphenol ethoxylate, polyoxyethylene glycol ethers of $C_{12}$–$C_{15}$ fatty alcohol such as Ceteareth-27 (Plurofac A-38, BASF-Wyandotte) or Pareth 25-7 (Neodol 25-7, Shell), and the like; carboxylic acid esters such as glycerol esters, polyoxyethylene esters, ethoxylated and glycol esters of fatty acids, and the like; carboxylic amides such as ethanolamine condensates, monoalkanol amine condensates, polyoxyethylene fatty acid amides, and the like; and polyalkylene oxide block copolymers including an ethylene oxide/propylene oxide block copolymer such as those commercially available under the trademark PLURONIC 25R8 (BASF-Wyandotte), and the like; and other like nonionic compounds.

Cationic surfactants useful for inclusion in a cleaning composition for sanitizing or fabric softening, include amines such as primary, secondary and tertiary monoamines with $C_{18}$ alkyl or alkenyl chains, amine oxides, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$–$C_{18}$) dimethylbenzyl ammonium chloride, n-tetradecyldimethylbenzylammonium chloride monohydrate, a naphthylene-substituted quaternary ammonium chloride such as dimethyl-1-naphthylmethylammonium chloride, and the like; and other like cationic surfactants.

Also useful are zwitterionic surfactants such as β-N-alkylaminopropionic acids, N-alkyl-β-iminodipropionic acids, imidazoline carboxylates, N-alkylbetaines, sultaines, and the like.

Other Additives

Urea-based compositions made according to the invention may further include conventional additives such as a chelating/sequestering agent, bleaching agent, alkaline source, secondary hardening agent or solubility modifier, detergent filler, defoamer, anti-redeposition agent, a threshold agent or system, aesthetic enhancing agent (i.e., dye, perfume), and the like. Adjuvants and other additive ingredients will vary according to the type of composition being manufactured.

Bleaching Agents

Bleaching agents for use in cleaning compositions for lightening or whitening a substrate, include bleaching compounds capable of liberating an active halogen species, such as —Cl, —Br, —OCl and/or —OBr, under conditions typically encountered during the cleansing process. Suitable bleaching agents for use in the present cleaning compositions include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorides, monochloramine and dichloramine, and the like. Encapsulated chlorine sources may also be used to enhance the stability of the chlorine source in the composition (see, for example, U.S. Pat. No. 4,618,914, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, preferably about 0.1–10 wt-%, preferably about 1–6 wt-%.

Coatings

Coatings used in manufacturing the detergent articles of the invention comprise both soluble and insoluble organic materials that can form an integral coating on the detergent mass. The integral coating substantially covers the surface of the detergent mass preventing the absorption of environmental water from the atmosphere into the surface of the detergent mass. Further, the coating prevents contact between operators of ware washing equipment from contact with the highly alkaline caustic nature of the material.

The coating comprises a continuous layer covering substantially the entire detergent mass having a thickness of about 0.1 to 12 millimeters, preferably about 0.5 to 3 millimeters. Preferably as little as possible of the coating materials is used to provide an adequate barrier. Consequently, the detergent article comprises about 0.3 to 50 wt-%, preferably 1 to 10 wt-%, most preferably about 1 to 5 wt-% based on the total weight of the coated detergent article. Maintaining the integrity of the water excluding coating is important to maintain stability of the detergent mass. The detergent mass should be cast with surface imperfections that extend from the surface of the detergent mass to a degree that the imperfections do not breach the coating after formation. The coating must form an adequate seal covering all surface distortions.

Coatings that can be used to manufacture the detergent article of the invention are those coatings which are chemically stable to the chemical constituents of the detergent mass. Both water soluble and water insoluble coatings can be used. The coatings can be introduced onto the detergent mass using any conventional coating technique such as coextrusion, spray coating, curtain coating, immersion, surface molding and others. Combinations of coating processes can also be used to ensure that a complete coating is formed. For example, an initial coating can be coextruded surrounding an extruded detergent mass core. Such a process would leave open uncoated ends on the detergent mass. Such an article can be further coated using spraying, curtain coating, etc. to seal the ends.

Coating compositions can comprise materials that are applied in the form of liquids. Such liquids can be room temperature solids that can be applied in the form of a heated melt or in the form of a solvent based solution or dispersion. Such dispersions can be made using water as a liquid base or using other solvents such as ethanol, methanol, propanol, petroleum ether, benzene toluene, etc. Preferably solvent based materials are applied in the form of aqueous dispersions for reasons of cost and safety. Dispersion materials useful for manufacturing the detergent articles of the invention comprise dispersions that can be sprayed or otherwise coated on the detergent mass of the invention leaving a coating after the aqueous or other vehicle has evaporated. Such dispersions preferably comprise 10–80 wt-% solids, the balance being water stabilizers and other functional ingredients. The dispersion should have a viscosity that permits ease of coating but should maintain sufficient solids to rapidly coat the detergent mass. Suitable dispersions for use in the coatings of the composition include poly (ethylene-co-vinylacetate), poly(ethylene-co-acrylic acid), poly(ethylene-co-methylacrylate), acrylic homopolymers such as polyacrylic acid, polymethacrylic acid, polymethylmethacrylate, styrene-butadiene-styrene copolymers, styrene-acrylic copolymers.

The coatings can also be applied in the form of an aqueous solution of materials. Soluble materials can include soluble polymeric materials such as soluble surfactants, soluble cellulosic materials, soluble salts, etc. Examples of such materials include polyethylene glycol (polyethylene oxide), polyethylene oxide, polypropylene oxide, block copolymers, polyacrylic acid, etc. Such soluble barrier layer coating materials can have, for example, solubility less than about 70 grams per 100 grams of water at 30° C.

The coatings of the invention can also be applied in the form of a melt material. Such materials are commonly substantially organic compositions having a melting point greater than about 30° C., preferably about 35°–55° C., have a melt viscosity that can obtain a continuous, uniform coating at about 30°–60° C., can provide a substantial mass in the coating on the detergent mass of the invention to obtain moisture barrier properties and are stable to the presence of the alkaline materials in the detergent mass. Among the useful coatings include waxy materials. Such waxes include low molecular weight (e.g. 1000–6000 molecular weight) polyethylenes having a softening point of about 66° to about 150° C. and petroleum waxes such as paraffin wax having a melting point of from about 60° to about 100° C., microcrystalline wax having a melting point from about 60° to about 100° C. Synthetic waxes made by polymerizing carbon monoxide and hydrogen such as Fisher-Tropsch wax. Further, hydrogenated animal or vegetable fats or oils can also be used if possessing the appropriate melting points and melt viscosity. Such oils include lard, hydrogenated soy bean oil, hydrogenated cotton seed oil, and hydrogenated castor oil. Further, hydrogenated fatty acids obtained from the oils discussed above can also be used as coating materials. Further derivatives of the fatty acids set forth above can be used as coating materials. Preferred fatty acid derivatives include fatty acid amides made by reacting a $C_6$–$C_{20}$ fatty acid with nitrogen bases. Preferred nitrogen bases include ammonia and an amine. Preferred amines include methyl amine, dimethyl amine, ethyl amine diethyl amine, monoethanol amine, diethanol amine, and other reactive amines providing at least one active hydrogen on the amine nitrogen for reaction with the fatty acid carboxylic acid group. Preferred coating materials for use in a melt coating composition of the invention include hydrogenated and non-hydrogenated coco fatty acid, hydrogenated and non-hydrogenated stearic acid, hydrogenated and non-hydrogenated stearic acid monoethanol amide, hydrogenated and non-hydrogenated stearic acid diethanol amide, paraffin wax, polyethylene glycol having a molecular weight ranging from about 1000 to 10,000, pluronic block copolymers comprising at least one polyethylene oxide block and at least one polypropylene oxide block having molecular weights of about 1000 to 10,000.

The coating compositions formed on the detergent mass can comprise a single layer comprising the organic material. Further, the coating can comprise a single layer of organic material with inorganic materials used as diluents or as materials that can promote the solubility or other removal of the coating. Such organic coatings can contain as an inorganic component, sodium chloride, sodium sulfate, sodium carbonate, sodium acetate, sodium metasilicate, sodium phosphate, trisodium phosphate, trisodium polyphosphate, sodium acrylic polymers inorganic hydrated salts and others present in an amount from about 1 to 50 wt. %. The organic coatings that optionally can contain some proportion of inorganic material can also be used with other coating layers. The organic coating can be formed over a wholly inorganic coating comprising materials discussed above or can be used with a separate distinct organic coating as discussed above.

Film Enclosure

Once coated the detergent article of the invention can be packaged in a separate film envelope. The envelope can be water soluble or water insoluble. Water soluble envelopes disclosing the detergent article of the invention can be manufactured from a number of water soluble films which are available commercially. Suitable water soluble film forming materials included, but are not limited to polyvinyl alcohol, polyvinyl acetate, methyl cellulose, hydroxyethyl cellulose, carboxymethyl cellulose, carboxymethyl hydroxyethyl cellulose, polyvinyl pyrrolidone, polyalkyloxazoline and film forming derivatives of polyethylene glycol. Polyvinyl alcohol which is preferred as a water soluble film is an excellent film forming material, has good strength and pliability under most operating conditions. Commercially available polyvinyl alcohol compositions for casting as films vary in molecular weight and degree of hydrolysis for most film applications, molecular weights in the range of about 10,000 to about 100,000 are preferred. Hydrolysis is the percent by which acetate groups of the precursor polyvinyl acetate has been removed leaving hydroxyl groups on a polyvinyl alcohol material. For film applications the range of hydrolysis typically is about 70 to about 99.9+%. The term polyvinyl alcohol always includes some residual acetate material remaining on the polyvinyl alcohol backbone. Since water soluble films and water soluble bags are manufactured from a number of sources including monosol films from Chris Kraft Industries. Suitable water insoluble film forming materials include, but are not limited to polyolefins such as polyethylene, polypropylene, polyvinyl chloride, polyvinylidene dichloride polyesters such as, polyethylene terephthalate, poly(ethylene-covinyl alcohol), polyethylene-co-acrylic acid, polyimide, nylon and other structural materials. Such water insoluble envelopes need to be physically removed prior to insertion of the detergent article into a dispenser, such films can be removed simply by tearing the film at any appropriate location on the film surface. However, the film envelopes can be manufactured containing means to promote film envelope removal. Materials useful in the film envelope used in packaging the detergent article should be capable of forming an in tact envelope surrounding the detergent article, should have a minimum tensile strength at break of about 5000–10,000 psi, should have a minimum tear resistance of about 75–100 g/mil, should have a thickness from about 1 to 15 mil, preferably about 1.5 to 7 mil.

The detergent mass can take any appropriate shape suitable for coating and for final packaging in the film envelope if used. We have found that preferred shapes for use in the detergent article can comprise shapes having large internal volumes with minimal external surface area. Accordingly, preferred shapes include generally spherical masses, cylindrical masses, generally square masses, etc. Such shapes reduce the amount of coating required to prevent moisture from contaminating the surface of the detergent mass. Further, these shapes can be manufactured with minimal surface imperfections that can render the surface coating ineffective for protecting the surface of the detergent mass. The mass can be in the shape of a cylindrical mass having a height of 2 to 8 inches and a diameter of 2 to 8 inches, preferably having a height of 3 to 6 inches and a diameter of 4 to 8 inches, or in the shape of a spherical mass having a diameter of 2 to 8 inches preferably of 3 to 7 inches.

The following examples provide a basis for understanding certain embodiments of the invention and contain a best mode. All parts are parts by weight.

EXAMPLE 1

Coating

An organic coating composition was made by introducing into a heated glass beaker about 98.82 parts of a stearic acid diethanol amide, 0.08 part of a dye and 1 part by weight of an EO/PO defoamer polymer composition. The mixture was heated until melted, stirred until uniform and was set aside to coat an alkaline detergent mass.

EXAMPLE 2

Into a heated beaker is placed a polyethylene glycol (ethylene oxide homopolymer) having a molecular weight of about 8000 and trisodium phosphate hydrate (12 moles of water). The weight ratio of the material was about 3:1 polymer to phosphate. The contents were heated and mixed until uniform. The contents were then removed from heat and maintained for coating experiments.

EXAMPLE 3

Using the procedure of Examples 1 or 2, a coating material was made comprising approximately a 1:1 weight ratio of a non-ionic surfactant material comprising a polyoxypropylene, polyoxyethylene, polyoxypropylene block copolymer having on the average 18 moles of propylene oxide, 163 moles of ethylene oxide and 18 moles of propylene oxide (PLURONIC 25R8 - BASF-Wyandotte) and stearic acid.

EXAMPLE 4

Solid Alkaline Detergent

Into a stirred beaker equipped with a heating element was placed 15.984 parts by weight of a 50 wt-% active aqueous sodium hydroxide solution, 0.5 part by weight of a sodium chlorite ($NaClO_3$) solution, 3.133 parts by weight of hard water, 0.5 part of nonionic surfactants, 4 parts by weight of a 50 wt-% active solution of polyacrylic acid and the mixture was stirred until uniform. Into the stirred mixture was then added 38.484 parts of bead sodium hydroxide, 6.496 parts of dense ash ($Na_2CO_3$) and a 30.9 parts by weight of sodium tripolyphosphate coated with nonionic surfactant. The mixture was stirred until uniform and cast into a number of four pound spheres using a plastic container/mold.

EXAMPLE 5

The cast solid sphere of Example 4 was coated with the coating of Example 1 by dipping the sphere into a heated container enclosing a melt of the coating material of Example 1. The coating formed on this sphere in a continuous uniform layer and comprised approximately 4 wt-% of the cast material.

EXAMPLE 6

Example 5 was repeated with the coating composition of Example 2.

EXAMPLE 7

Example 5 was repeated except with the coating composition of Example 3.

EXAMPLE 8

The method of Example 6 was repeated except that the melt coating composition comprised a poly ethylene glycol (polyethylene oxide homopolymer) having a molecular weight of 8000 in place of the blended coating composition.

EXAMPLE 9

The coated alkaline detergent product of Example 8 was further coated by spraying onto the coated detergent block an aqueous solution comprising approximately 55 parts by weight of soft water and approximately 45 parts by weight of trisodium phosphate hydrate (12 moles water).

EXAMPLE 10

A sphere of Example 4 was coated with a polyacrylic acid homopolymer having an average molecular weight of about 4500. The coating on the spherical cast solid was formed by spraying onto the cast solid an approximately 50 wt-% active aqueous solution of the polyacrylic acid homopolymer until a uniform coating was formed.

Stability

The stability testing consists of monitoring the weight gain and visual changes that occur to the samples. The samples are tested using three storage conditions. The storage conditions consist of 100° F.-65%RH, Cycle 100° F.-65%RH, and room temperature (72° F.-50%RH).

The following data table displays the sample disposition, sample ID, coating weight percent, and percent weight gained per time. The data table also shows the average coating weight percent and percent weight gained per time. The data reveals that the samples are gaining weight slowly but stability is excellent.

STEARIC ACID AMIDE SOLID ON CAUSTIC SOLID % WEIGHT GAIN

| Sample Disposition | | Sample ID | Coating Wt-% | 4 Days | 24 Days | 43 Days |
|---|---|---|---|---|---|---|
| RT | 72° F. 50% | 43F | 7.79% | 0.06% | 0.22% | 0.42% |
| RT | 72° F. 50% | 43G | 8.84% | 0.08% | 0.24% | 0.43% |
| RT | 72° F. 50% | 43M | 10.89% | 0.10% | 0.32% | 0.56% |
| RT | 72° F. 50% | 43N | 11.74% | 0.10% | 0.28% | 0.50% |
| DISP | 100° F. 65% | 43A | 12.13% | — | — | — |
| DISP | 100° F. 65% | 43B | 7.90% | — | — | — |
| DISP | 100° F. 65% | 43H | 8.58% | — | — | — |
| DISP | 100° F. 65% | 43K | 11.82% | — | — | — |
| DISP | 100° F. 65% | 43L | 11.76% | — | — | — |
| DISP | 100° F. 65% | 43O | 11.33% | — | — | — |
| DISP | 100° F. 65% | 43P | 9.06% | — | — | — |
| DISP | 100° F. 65% | 43R | 10.95% | — | — | — |

-continued

STEARIC ACID AMIDE SOLID ON CAUSTIC SOLID % WEIGHT GAIN

| Sample Disposition | | Sample ID | Coating Wt-% | 4 Days | 24 Days | 43 Days |
|---|---|---|---|---|---|---|
| CYCLE | | 43C | 8.95% | 0.17% | 0.47% | 0.55% |
| CYCLE | | 43I | 8.53% | 0.20% | 0.75% | 0.94% |
| CYCLE | | 43U | 8.67% | 0.17% | 0.53% | 0.65% |
| CYCLE | | 43Y | 9.95% | 0.21% | 0.72% | 0.87% |
| | 100° F/65% RH | 43D | 7.98% | 0.22% | 0.54% | 0.75% |
| | 100° F/65% RH | 43E | 7.58% | 0.21% | 0.50% | 0.67% |
| | 100° F/65% RH | 43J | 9.12% | 0.25% | 0.64% | 0.88% |
| | 100° F/65% RH | 43Q | 11.67% | 0.28% | 0.69% | 0.96% |
| | 100° F/65% RH | 43S | 11.23% | 0.28% | 0.65% | 0.87% |
| | 100° F/65% RH | 43T | 9.54% | 0.24% | 0.59% | 0.79% |
| | 100° F/65% RH | 43V | 10.91% | 0.30% | 0.83% | 1.18% |
| | 100° F/65% RH | 43W | 10.51% | 0.29% | 0.81% | 1.12% |
| | 100° F/65% RH | 43X | 10.63% | 0.33% | 0.89% | 1.27% |
| | 100° F/65% RH | 43Z | 13.54% | 0.33% | 0.84% | 1.16% |
| | 100° F/65% RH | AVG | 10.27% | 0.27% | 0.70% | 0.96% |
| | CYCLE | AVG | 9.03% | 0.19% | 0.62% | 0.76% |
| | RT | AVG | 9.81% | 0.09% | 0.26% | 0.48% |

Performance

The dispensing performance The spot and film performance test consisted of evaluating the two solid barrier coatings on a caustic solid detergent article and a standard SOLID POWER® a brand detergent. The test evaluated redeposition and milk glasses for spotting and filming after 20 cycles in a Hobart C-44. The test conditions were city water (4.5 grains), 1500 ppm of beef stew soil, and 1000 ppm of hot point soil.

Dispensing

The dispensing test consisted of evaluating the two suppliers and comparing them with standard Solid Power. The equipment used was a modified Solitron 1000/1500 dispenser. The dispensing conditions consisted of; City water, 5.6–90° spray nozzle operating at 20 psig.

The modifications consisted of a sleeve (7 in OD and 5.25 in ID) that fits inside the dispenser. The sleeve adapts the current 7 in diameter dispenser to a 5.25 in diameter dispenser. The sleeve rests on a grate (6.25 in OD and 2 in ID). The grate is flat and shaped like a doughnut. The grate supports the product and the sleeve. The inner hole allows the water to spray on the product without any interference.

The Solid Power standard product starts at its initial weight and dispensing rate decreases with increasing time (cycles). The Solid on Solid product (labeled W or RP) exhibits a dispensing delay before the coating dissolves. This occurrence is much more evident at 115° F. The Solid on Solid samples dispense exactly like standard Solid Power once part of the coating dissolves. The amount of delay time at 115° F. is 20 min and 30 sec at 145° F.

A high temperature is needed to reduce the delay time. If this condition is met, no problems should occur with delay times. The water used in dispensing the detergent mass should therefore preferably be at a temperature of about 130°–150° F.

SUMMARY OF RESULTS
SOLID ON SOLID

| TEST | CONDITIONS | Pwr BALL Witco | Pwr BALL RP | SOLID POWER |
|---|---|---|---|---|
| Dispensing | | | | |
| Charge Time (min) | 115° F. | 39.0 | 20.5 | 0.0 |

-continued

SUMMARY OF RESULTS
SOLID ON SOLID

| TEST | CONDITIONS | Pwr BALL Witco | Pwr BALL RP | SOLID POWER |
|---|---|---|---|---|
| 20 psi, 5.6/90 nozzle | 145° F. | 1.0 | 30 (sec.) | 0.1 |
| Total Time (min) | 115° F. | 137.5 | 175.0 | 37.5 |
| 20 psi, 5.6/90 nozzle | 145° F. | 17.5 | 22.0 | 17.5 |
| 20 Cycle Spot & Film | | | | |
| Milk, Spot (Film) | 1000 ppm | 4(2.33) | 4(2.33) | 5(2.5) |
| | 2000 ppm | 1(2.67) | 1(2.5) | 1(2.17) |
| Redep, Spot (Film) | 1000 ppm | 2(2.17) | 1(2.33) | 3(2.5) |
| | 2999 ppm | 1(2.33) | 1(2.5) | 1(2.33) |
| Surface Tension (dynes/cm) | | | | |
| | 0 ppm | | 73.0 | 73.0 |
| | 1 ppm | | 57.0 | 73.0 |
| | 25 ppm | | 36.7 | 73.0 |

The data is shown in table form. The data shows that at 1000 ppm (0.1%) all of the products had the same film rating, but the solid on solid samples had reduced the spotting. This result is understandable considering that Stearamide diethanol amide coating material is a surfactant. The 2000 ppm (0.2%) milk glasses showed similar results on spot and film for all products.

The data shows again that at 1000 ppm the solid on solid reduces the spotting. The 2000 ppm samples all gave the same results.

The significance of the performance testing tells us that solid on solid does not have any detrimental effects on product performance such as spotting or surface tension. In fact, at lower concentrations it can reduce spotting.

The detergent mass of the invention can be manufactured by casting a liquid melt or a liquid dispersion, compacting powder into a solid, compacting pellets into a solid, or using any other manufacturing scheme that would result in a detergent mass having mechanical stability and a minimum mass of about 100 grams. Representative examples of patents teaching such manufacturing methods include Fernholz et al., U.S. Reissue Nos. 32,763 and 32,818, Heile et al., U.S.

Pat. Nos. 4,680,134 and 4,595,520. The most common method for manufacturing the cast solid detergent mass of the invention involves slurrying the desired ingredients in an aqueous medium at a concentration such that a hydrated alkaline salt is formed having a melting point of less than about 50° C. If the materials are manufactured at a temperature greater than 50° C., the combined materials will freeze when cooled. Alternatively, the materials can be slurried using anhydrous materials that when hydrate, solidify into the detergent mass.

One additional method for forming the cast solid detergent articles of the invention involves using extrusion technology wherein the materials of the detergent are suspended in an aqueous medium which is mixed and extruded in the form of a cylindrical extrudate which can rapidly harden to form the detergent mass. These manufacturing methods are disclosed in copending U.S. Ser. Nos. 08/175,714, 08/176,541, and 08/441,252. However, any manufacturing technique that can form a stable detergent mass having greater than about 100 grams can be used.

Preferred coatings used on the detergent mass to form an alkaline detergent article comprise substantially water resistant materials that can form a continuous coating formed on the exterior of the detergent mass separating the detergent mass from contact with the user and from contact with the environment.

Even though several characteristics and advantages of the invention have been set forth in the foregoing description, together with the details of the structure and function of the invention, the disclosure is illustrative only, and changes may be made in detail, especially in matters of shape, size and arrangement of parts, within principles of the invention, to the full extent indicated by the broad, general meaning of the appended claims.

We claim:

1. A coated solid block detergent article, stabilized to the effects of heat and humidity in the ambient environment, said coated article comprising a detergent block comprising a mass greater than 100 grams comprising at least 10 wt-% of a source of alkalinity selected from an alkali metal hydroxide, an alkali metal carbonate, an alkali metal silicate or mixtures thereof, the article uniformly coated with an integral, surface coating, barrier layer, said surface coating, barrier layer comprising a fatty acid amide, the coated detergent article adapted to be dispensed by an aqueous spray-on dispenser, wherein said surface coating, barrier layer protects the block from the absorption of greater than about 5 grams of water per 100 grams of detergent per 30 days and said surface coating, barrier layer [coating] also permlits safe handling of the detergent block during use.

2. The article of claim 1 wherein the detergent block comprises about 10 to 75 wt-% of a source of alkalinity, about 1 to 40 wt-% of an organic or inorganic sequestrant composition; and about 1 to 30 wt-% of water.

3. The article of claim 1 wherein the detergent block comprises about 0.5 to 5 kilograms.

4. The article of claim 1 wherein the surface coating barrier layer has a melting point greater than about 30° C.

5. The article of claim 1 wherein the fatty acid amide is made from a monoalkanol amine or a dialkanol amine and a $C_{6-20}$ fatty acid.

6. The article of claim 1 wherein the surface coating barrier layer has distributed therein about 1 to 50 wt-% of an inorganic hydrated salt.

7. The detergent article of claim 1 wherein the detergent block comprises a cylinder having a height of 3–6 inches and a diameter of 4–8 inches.

8. The detergent article of claim 1 wherein the detergent block comprises a spherical mass having a diameter of 3–7 inches.

9. A packaged coated detergent article comprising:

(a) the detergent article of claim 1 and (b) a film envelope enclosing the article.

10. The article of claim 9 wherein the film envelope is insoluble in an aqueous medium.

11. The article of claim 9 wherein the film envelope comprises a polyolefin, a polyvinyl chloride, a polyvinylidene dichloride, or a polyester.

12. The article of claim 9 wherein the film envelope is soluble in an alkaline aqueous medium.

13. The article of claim 9 wherein the film envelope comprises a polykethylene-co-acrylic) composition.

14. A method of dispensing a detergent article comprising inserting the detergent article of claim 1, packaged in a film envelope soluble in water or in an alkaline aqueous solution, into a spray on dispenser, and spraying onto the film envelope and detergent article an aqueous stream that can dissolve and remove the film, the barrier layer coating and at least some portion of the detergent mass to create an alkaline detergent concentrate for use in a washing locus.

15. The method of claim 14 wherein the film comprises a polyvinyl alcohol.

16. The method of claim 14 wherein the film comprises a poly(ethylene-coacrylic acid).

17. The method of claim 14 wherein the film comprises a poly(ethylene-covinyl alcohol).

18. A method of dispensing a coated alkaline solid block detergent article comprising:

(a) exposing a portion of the surface of a coated alkaline detergent block, having a mass of greater than 100 grams, comprising at least 10 wt-% of a source of alkalinity selected from an alkali metal hydroxide, an alkali metal carbonate, an alkali metal silicate or mixtures thereof, said detergent block uniformly coated with an integral, surface coating, barrier layer, said surface coating, barrier layer comprising a fatty acid, amide, the coated detergent article adapted to be dispensed by an aqueous spray-on dispenser, wherein said surface coating barrier layer protects the block from the absorption of greater than about 5 grams of water per 100 grams of detergent per 30 days to form a dispensable detergent article; and (b) inserting the dispensable solid block detergent article into a dispenser comprising a water spray positioned such that the spray dispenses the exposed detergent block.

19. The method of claim 18 wherein prior to exposing a surface of the detergent block, a film is removed from the detergent article.

20. The method of claim 19 wherein the film is a water insoluble polymeric film selected from the group consisting of a polyolefin film, a polyvinylidene dichloride film, a polyvinyl chloride film and a polyester film.

21. The method of claim 18 wherein the water used in dispensing the detergent mass has a temperature of about 130°–150° F.

22. A coated solid block detergent article, stabilized to the effects of heat and humidity in the ambient environment, said coated article, comprising a block having a mass of at least 100 grams, comprising at least 10 wt-% of an alkali metal hydroxide, a water softening amount of a hardness sequestering agent, and an effective amount of water of hydration to render the detergent block a solid, said block uniformly coated with a substantially organic integral, surface coating, barrier layer, said surface coating, barrier layer comprising a fatty acid amide, said barrier layer and article adapted to be melted and dispensed by an aqueous spray-on dispenser, wherein said barrier layer protects the block from the absorption of greater than about 5 grams of water per 100 grams of detergent per 30 days, said surface coating, barrier layer also permits safe handling of the detergent block during use, said organic integral surface coating barrier layer comprising an organic coating material having a melting point of greater than 30° C.

23. The article of claim 22 wherein the detergent block comprises about 10 to 75 wt-% of sodium hydroxide, about 1 to 40 wt-% of sodium tripolyphosphate and about 1 to 30 wt-% of water of hydration.

24. The article of claim 22 wherein the fatty acid amide is made from a monoalkanol amine or a dialkanol amine and a $C_{6-20}$ fatty acid.

25. A method of manufacturing a coated solid block detergent article having a mass of greater than 100 grams, stabilized to the effects of heat and humidity in the ambient environment, said coated article comprising at least 10 wt-% of a source of alkalinity selected from an alkali metal hydroxide, an alkali metal carbonate, an alkali metal silicate or mixtures thereof, said method comprising extruding a thickened liquid detergent mass from an extruder in the form of an extrudate having a diameter of 2 to 8 inches forming the extrudate into a cylindrical mass having a height of 2 to 8 inches permitting the extrudate to solidify, coating the extrudate with an integral, surface coating, barrier layer, said surface coating, barrier layer comprising a fatty acid amide, said barrier layer and article adapted to be dispensed by a spray-on aqueous dispenser, said barrier layer protects the mass from the absorption of greater than about 5 grams of water per 100 grams of detergent for 30 days, said barrier layer also permitting safe handling of the detergent block during use; and packaging the detergent block in a film envelope.

26. The method of claim 25 wherein the detergent block comprises about 10 to 75 wt-% of an alkali metal hydroxide, about 1–40 wt-% of an organic or inorganic sequestrant composition; and about 1–30 wt-% of water of hydration.

27. The method of claim 25 wherein the surface coating, barrier layer has a melting point of greater than about 30° C.

28. The method of claim 25 wherein the fatty acid amide is made from a monoalkanol amine or a dialkanol amine and a $C_{6-20}$ fatty acid.

29. The method of claim 25 wherein the film envelope comprises a polyolefin film, a polyvinyl chloride film, a polyvinylidene dichloride film or a polyester film.

30. The method of claim 25 wherein the film is soluble in an aqueous medium.

31. The method of claims 25 wherein the film is soluble in an alkaline aqueous medium.

32. A method of manufacturing a coated solid block detergent article stabilized to the effects of heat and humidity in the ambient environment, said coated article comprising a mass of at least 100 grams comprising at least 10 wt-% of a source of alkalinity selected from an alkali metal hydroxide, an alkali metal carbonate, an alkali metal silicate or mixtures thereof, said method comprising forming a cast solid block by solidifying a thickened liquid detergent mass in the shape of a cylindrical mass having a height of 2 to 8 inches and a diameter of 2 to 8 inches or a sphere having a diameter of 2 to 8 inches, uniformly coating the cast solid block with an integral, surface coating, barrier layer, said surface coating, barrier layer comprising a fatty acid amide, said barrier layer and article adapted to be dispensed by a spray-on aqueous dispenser, said surface coating barrier layer protects the block from the absorption of greater than about 5 grams of water per 100 grams of detergent for 30 days, said surface coating barrier layer also permitting safe handling of the detergent block during use; and packaging the detergent block in a film envelope.

33. The method of claim 32 wherein the detergent block comprises about 10 to 75 wt-% of an alkali metal hydroxide, about 1 to 40 wt-% of an inorganic sequestrant composition and about 1 to 30 wt-% of water of hydration.

34. The method of claim 32 wherein the surface coating barrier layer has a melting point of greater than about 30° C.

35. The method of claim 32 wherein the fatty acid amide is made from a monoalkanol amine or a dialkanol amine and a $C_{6-20}$ fatty acid.

36. The method of claim 32 wherein the film envelope comprises a polyolefin film, a polyvinylchloride film, a polyvinylidene dichloride film or a polyester film.

37. The method of claim 32 wherein the film is soluble in an aqueous medium.

38. The method of claim 32 wherein the film is soluble in an alkaline aqueous medium.

* * * * *